US006405724B1

(12) United States Patent
Richard

(10) Patent No.: US 6,405,724 B1
(45) Date of Patent: Jun. 18, 2002

(54) VERTICAL STACK—VERTICAL DRAFT FIREPLACE GRATE

(76) Inventor: Jesse Richard, 219 Wheeler, Litchfield, CT (US) 06759

( * ) Notice: Subject to any disclaimer, the term of this patent is extended or adjusted under 35 U.S.C. 154(b) by 0 days.

(21) Appl. No.: 09/640,153

(22) Filed: Aug. 16, 2000

(51) Int. Cl.[7] ..... F24B 1/193

(52) U.S. Cl. ..... 126/540; 126/554; 126/298; 126/152 R

(58) Field of Search ..... 126/540, 554, 126/500, 298, 152 R, 152 A, 152 B, 541

(56) References Cited

U.S. PATENT DOCUMENTS

| | | | | | |
|---|---|---|---|---|---|
| 92,049 | A | | 6/1869 | Hinman | 126/541 |
| 176,560 | A | | 4/1876 | Stevenson | 126/540 |
| 177,464 | A | * | 5/1876 | Brown | 126/540 |
| D20,573 | S | | 3/1891 | Peterson | 362/159 |
| 493,056 | A | | 3/1893 | Beehler | 126/540 |
| 890,669 | A | | 6/1908 | Low | 126/298 |
| 1,418,411 | A | * | 6/1922 | Ward | 126/298 |
| 1,602,395 | A | | 4/1926 | Dixon | 126/540 |
| 2,031,732 | A | * | 2/1936 | Plym | 126/540 |
| 2,600,753 | A | | 6/1952 | Gilbert | 126/298 |
| 3,007,469 | A | | 4/1961 | Hill | 126/298 |
| 3,505,986 | A | | 4/1970 | Wood | 126/541 |
| 3,612,034 | A | | 10/1971 | Wood | 126/541 |
| 3,771,511 | A | | 11/1973 | Dahlquist | 126/540 |
| 4,019,493 | A | | 4/1977 | McCullough | 126/541 |
| 4,058,108 | A | | 11/1977 | Dahlquist | 126/298 |
| 4,069,808 | A | | 1/1978 | Cranberg | 126/541 |
| 4,086,905 | A | | 5/1978 | Dawson | 126/152 R |
| 4,215,671 | A | | 8/1980 | Nadolsky | 126/541 |
| 4,344,412 | A | * | 8/1982 | Perrin | 126/298 |
| 4,526,159 | A | * | 7/1985 | Vroome | 126/298 |
| 5,076,253 | A | | 12/1991 | Lindstro | 126/540 |

FOREIGN PATENT DOCUMENTS

| | | | |
|---|---|---|---|
| FR | 2 605 390 A1 | * | 4/1988 |
| GB | 2 324 856 A | * | 11/1998 |

* cited by examiner

*Primary Examiner*—Henry Bennett
*Assistant Examiner*—Josiah C. Cocks
(74) *Attorney, Agent, or Firm*—Theodore R. Paulding

(57) ABSTRACT

A vertical stack—vertical draft fireplace grate which has a forwardly inclined log retaining portion with a lowermost log in close proximity to the floor of the fireplace and which cooperates with the rear wall of the fireplace to hold logs in a V-shaped stack immediately adjacent the wall. Undesired smoke is eliminated, starting facilitated and heat radiation forwardly through the fireplace opening greatly enhanced, while both safety and automatic feeding features are also enhanced.

8 Claims, 5 Drawing Sheets

VERTICAL STACK— VERTICAL DRAFT FIREPLACE GRATE

BACKGROUND OF THE INVENTION

Conventional fireplace grates for supporting wood logs and the like generally take the form of a shallow U-shape viewed from the end. Such grates may be referred to as "basket grates" and serve the limited purpose of holding logs for combustion in a generally satisfactory manner. They do not, however, provide any assistance or assurance in preventing smoke pouring from the fireplace opening during starting of a fire, they are subject to dangerous situations especially when logs are piled high in a triangular configuration and when a partially burned log rolls forwardly onto a floor or carpet, they are not conducive to ease and convenience in starting fires, they are only nominally efficient in radiating heat forwardly through the fireplace opening, they are limited in automatic self-feeding capability, and they provide little or no control over burn rate or the size of the fire, the latter resulting only from constant attention in adding and/or limiting the number of logs stacked on the grates.

It is the general object of the present invention to provide a vertical stack—vertical draft fireplace grate which maintains a vertical stack of logs of limited width in close proximity to the rear wall of the fireplace, thus providing a narrow controlled column of fire and a corresponding narrow vertical draft pattern immediately adjacent the rear wall of the fireplace.

A further object of the present invention is to provide for a "quick draft" and thus completely eliminate smoke exiting from a fireplace opening on starting a fire.

Another object of the invention is to positively prevent logs from rolling forwardly from the grate onto the hearth and floor.

Still another object is to make starting a fire the simplest possible yet highly efficient procedure.

Still another object is to provide for an automatic self-feeding function and eliminate the necessity of constant attention from an occupant of the room in which the fireplace is located.

Still another object of the invention is to provide highly efficient radiation of heat from a fire and its associated bed of embers through the fireplace opening into the room in which the fireplace is located.

Still another object is to provide a grate that is nearly as efficient as that of a wood stove.

SUMMARY OF THE INVENTION

In accordance with the invention and in fulfillment of the foregoing objects, a vertical stack -vertical draft fireplace grate comprises a log retaining portion which faces generally forwardly and extends sharply angularly upwardly and forwardly from a rear and lower end location closely adjacent the corner formed by the floor and rear wall of the fireplace. The grate portion does not act alone, but instead, retains and supports logs in cooperation with the generally vertical rear wall of the fireplace and defines therewith a sharp generally V-shaped through opening viewed from the sides of the grate. The retaining portion comprises a plurality of parallel log supporting and retaining members spaced apart horizontally a sufficient distance to allow embers from the logs in the grate to radiate freely therebetween and form a deep, vertically, exposed ember bed build up therewithin as a fire progresses. The total area of forwardly open space between the supporting and retaining members is substantially greater than the total area of the members so as to permit heat generated by burning logs on the grate to radiate freely outwardly through the spaces and forwardly from the grate together with heat radiating forwardly from an ember bed within the lower portion of the grate. The grate is open at the top for the downward introduction of logs thereto, and the configuration at lower end portions of the supporting and retaining members is such that burning logs and embers fall into the grates lower portion and onto the fireplace floor as the fire progresses. A pair of legs extend forwardly with one end portion of each engaging the fireplace floor a substantial distance from the grate and the other end portion secured to the log retaining portion of the grate at a substantial distance above the fireplace floor to maintain stability of the grate with the latter carrying a maximum number of logs.

Further in accordance with the invention, the horizontal front to rear dimension of the grate at its lower end portion should be no greater than the diameter of an average log. More particularly, the horizontal dimension between the rear wall of the fireplace and the retaining portion of the grate is preferably no more than six (6) inches. In accordance with the presently preferred practice the dimension falls in the range of three (3) to five (5) inches, three and one half inches (3½) being presently preferred. The remaining portion of the grate has a vertical dimension at least twice that of its lower end horizontal dimension and preferably four to five times said dimension to accommodate stacking logs in at least an approximate V-shaped configuration. That is, although logs may not be stacked precisely one on top of the other and may instead be staggered to an extent, they are limited horizontally so as to form an overall cross sectional configuration substantially higher that it is wide. An eighteen (18) inch high grate is preferred. All dimensions quoted are appropriate when considering a fireplace opening of 3'×3' to 4'×4'.

A further important feature of the grate in accordance with the invention resides in the relationship that a growing ember bed rests on and makes contact with the fireplace floor, thus, allowing the draft to only contact the ember bed straight on horizontally and not from underneath as is common with other grates and irons.

The invention also features a design that incorporates a unique horizontal straight on draft, versus the normal under the fire draft with a basket grate. The straight on draft turns vertically upwardly on entering the stack of logs and fans the vertical portion of the ember bed at the rear portion of the fireplace, thus radiating maximum heat. At the same time most of the oncoming draft oxygen is exhausted in combustion at this point, which in turn slows the draft up the backside of the firebox which in turn reduces and controls the burn rate. As a result, this reduces wood consumption greatly and increases efficiency dramatically.

As will be apparent, the vertical stack—vertical rear draft grate of the present invention provides for substantially vertical forwardly inclined exposure of stacked firewood, several logs at a minimum. In starting a fire, the forwardly inclined or overhanging arrangement of the logs is of considerable assistance. Crumpled newspaper or other starting material may be pressed into position with kindling immediately adjacent thereto in the lower portion of the grate, avoiding the difficulty of forcing newspaper or the like into a narrow space beneath a conventional basket type grate. A rapid and efficient starting operation results. The kindling, or even small logs, ignite quickly with a column of heat rising immediately adjacent the rear wall of the fireplace and into the flue to both heats the wall and creates a "quick draft" which effectively provides a smokeless start.

Subsequent ignition of logs above the starting materials and kindling tends to occur on the rear surfaces of the forwardmost logs and on the bottom and upwardly about both side surfaces of the rear logs. Smoke, occurring on initial ignition at these locations is shielded by the upper and forwardmost logs and with air flowing rearwardly and horizontally inwardly therebetween, the smoke flows efficiently upwardly as desired and into the flue and little or no smoke issues from the fireplace opening.

As combustion continues, a bed of embers forms in the base of the grate and the adjacent rear fireplace wall in a generally vertical configuration viewed from the sides of the grate. A vertical wall of hot coals is eventually exposed forwardly and maximum heat radiation occurs therefrom through the fireplace opening into an adjacent room. The burning vertical stack of logs above the ember bed of course also radiates maximum heat forwardly as compared with a conventional basket grate where the greatest exposure of both the ember bed and burning logs occurs horizontally while only a narrow area of the ember bed and burning logs enjoys forward exposure so as to create heat radiation into an adjacent room. It is believed that heat radiation into an adjacent room is at least doubled with the vertical stack—vertical rear draft grate of the present invention.

Finally, the grate of the invention provides a self-feeding feature with logs placed atop a stack gradually igniting and descending sequentially until they are transformed to embers in the sub-adjacent ember bed. A stack of large hard wood logs has been found to retain embers through the night and easily restarted 8 hours later without using a match, or the like. Conversely, a much faster burn rate can be provided with small soft wood logs. In this regard, no extra attention is needed and the fire will automatically throttle itself, but at the same time the use of smaller and softer wood will give off more heat per hour.

DESCRIPTION OF PREFERRED EMBODIMENTS

Figure 1:
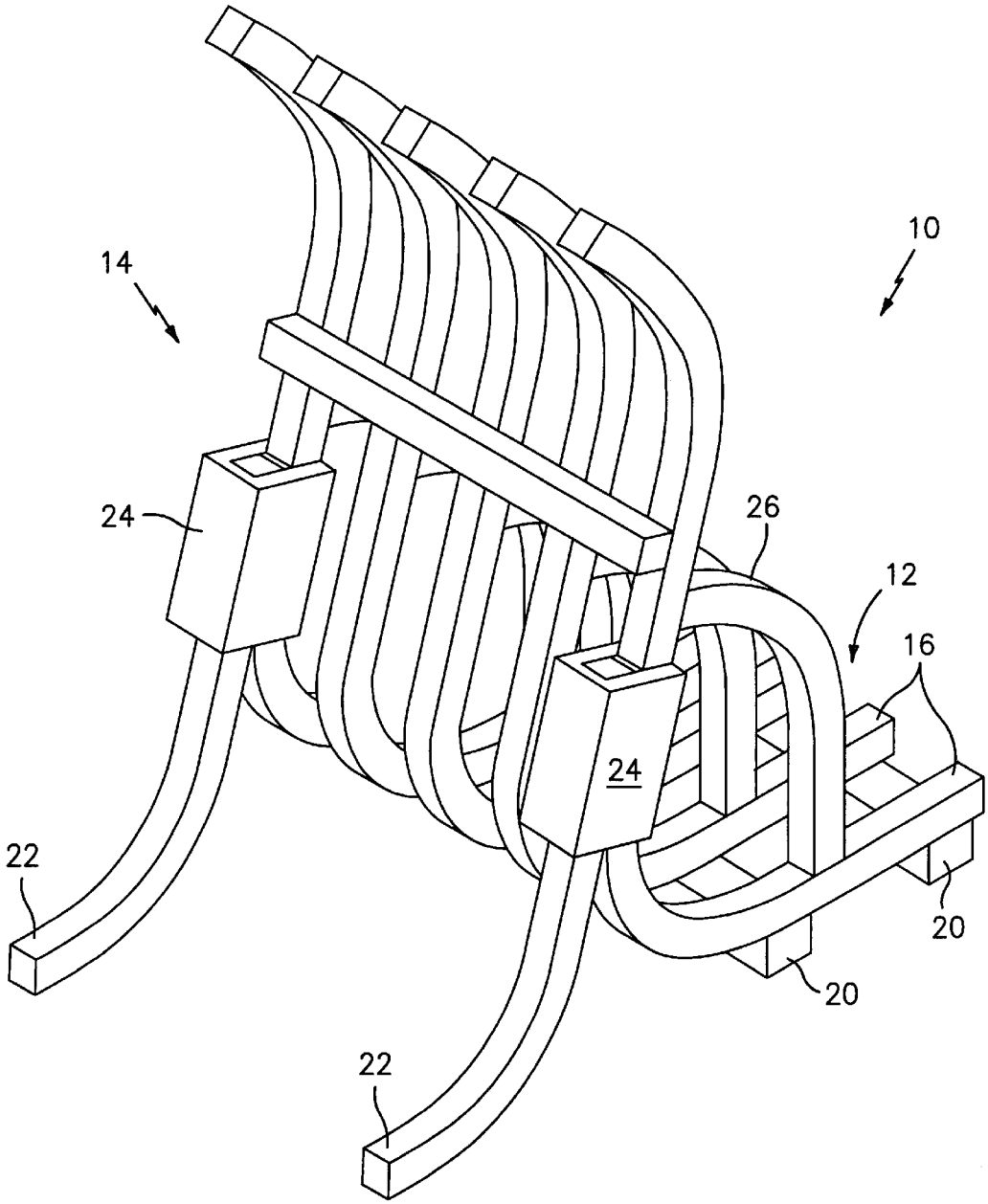
FIG. 1 of the drawings is a perspective view of a vertical stack fireplace grate constructed in accordance with the present invention, and forming a first embodiment thereof.

Referring to FIG. 1, a vertical stack—vertical draft fire place grate 10 has a log retaining portion 14 comprising of spaced apart members 16,16, five shown. Bosses 24,24 on the retaining members 16,16 receive and hold upper end portions of legs 22,22 which extend downwardly and curve forwardly for engagement with the floor of the fireplace. Legs 20,20 beneath the members 16,16 run transversely of the members and serve to interconnect and support the same in close proximity to the fireplace floor 21, FIG. 2.

Figure 2:
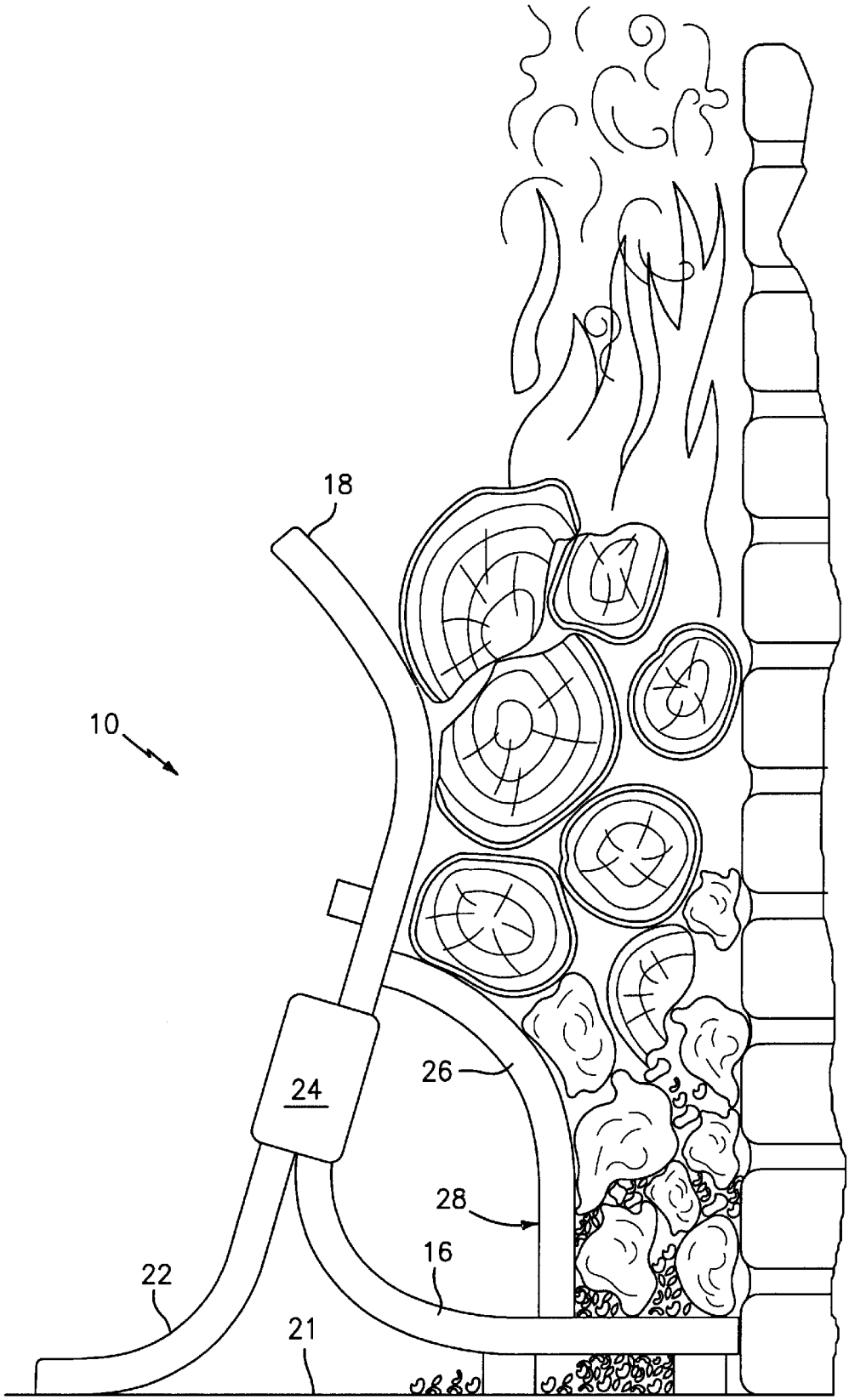
FIG. 2 is a side view of the grate of FIG. 2 shown in association with a floor and rear wall of a fireplace and filled with logs.

An important feature in accordance with the present invention, is provided in the form of auxiliary log supporting members 26,26, one shown. As best illustrated in FIG. 2, the members 26,26 support logs thereabove and is adapted to extend angularly and arcuately downwardly and rearwardly from their associated retaining members 16,16 where they are attached at their upper and front ends. At their rear ends the members 26,26 are also attached to horizontal rear portions of the log supporting members 16,16. As will be apparent, the members 26,26 thus provide for a V-shaped vertical stack configuration and a greatly enlarged ember bed therebeneath in a generally vertical form. That is, the front and upper ends of the members 26,26 are attached to the retaining members at a height above the fireplace floor which is at least equal to the diameter of two average sized logs as in FIG. 2 and more closely equal to the diameter of two and one-half to three average sized logs. The logs thus take the configuration shown in FIG. 2 with the embers indicated generally at 28 holding in a vertical position between the members 26,26 and the members 16,16. The two lowermost logs in FIG. 2 are shown partially burned and it will be apparent that they will eventually transform fully to embers as combustion continues, thus forming part of the vertical ember bed.

Figure 3:
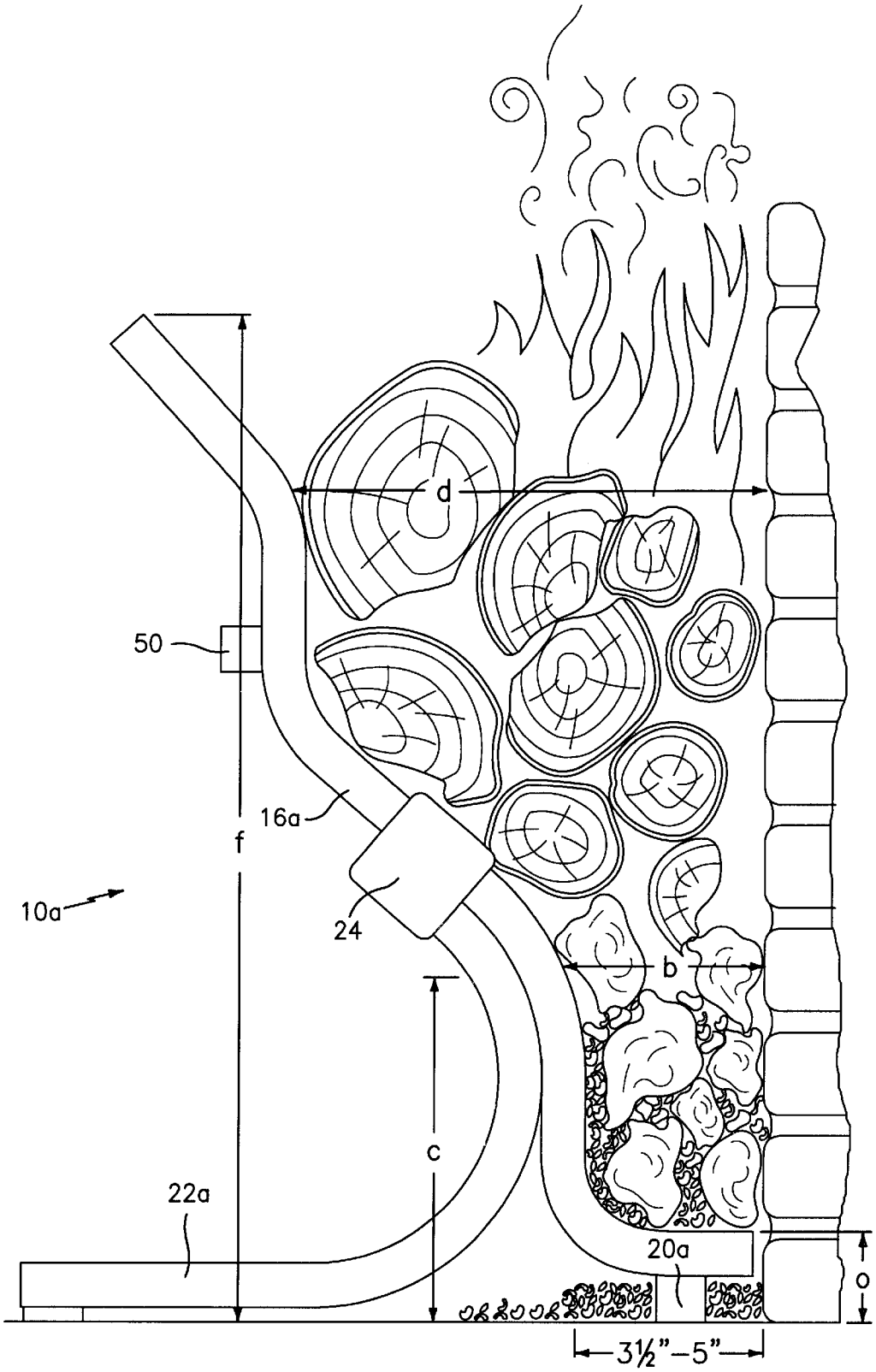
FIG. 3 is a side view of grate forming a second and presently preferred embodiment of the invention.
Figure 4:
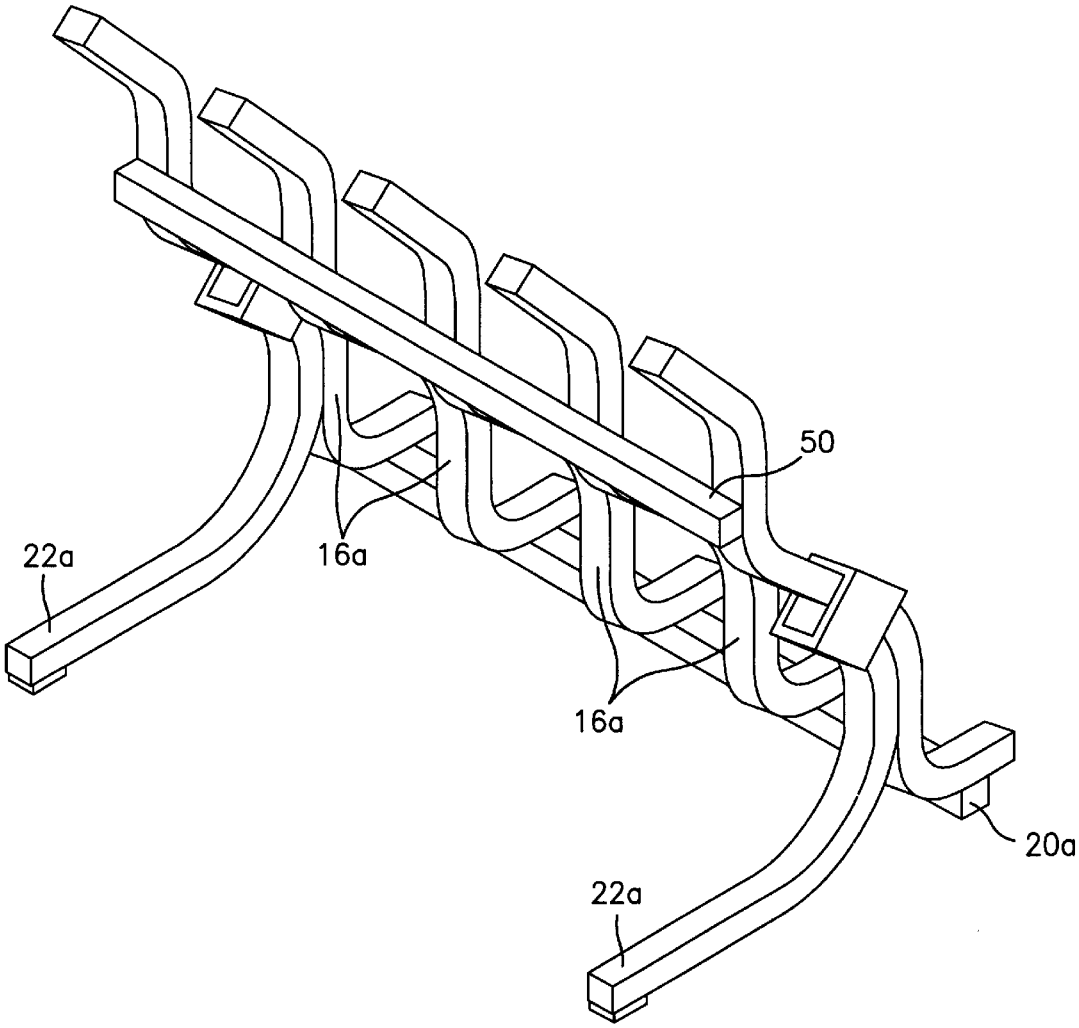
FIG. 4 is a perspective view of the FIG. 3 grate.

In FIGS. 3 and 4, the presently preferred form of the present invention is illustrated generally at 10*a*. The grate 10*a* is a simplified and yet highly efficient design with retaining members 16*a*, formed to provide the desired V-shape and a single transverse connector and rear leg 20*a* supporting the grate in cooperation with a pair of front legs 22*a*,22*a*, similar to the front legs of the FIGS. 1, 2 grate. An upper transverse frame member 50 secures the members 16*a*, in assembly. As in the case of the FIG. 1, 2 grate, the lowermost portion of the ember bed rests on and thus maintains itself in close proximity to the floor which inhibits air flow therebeneath and provides for burn rate regulation and control. The dimension "a" in FIG. 3 representing the distance between the fireplace floor and the lowermost log should not exceed that needed for fabrication and as shown is approximately two (2) inches or less.

Figure 5:
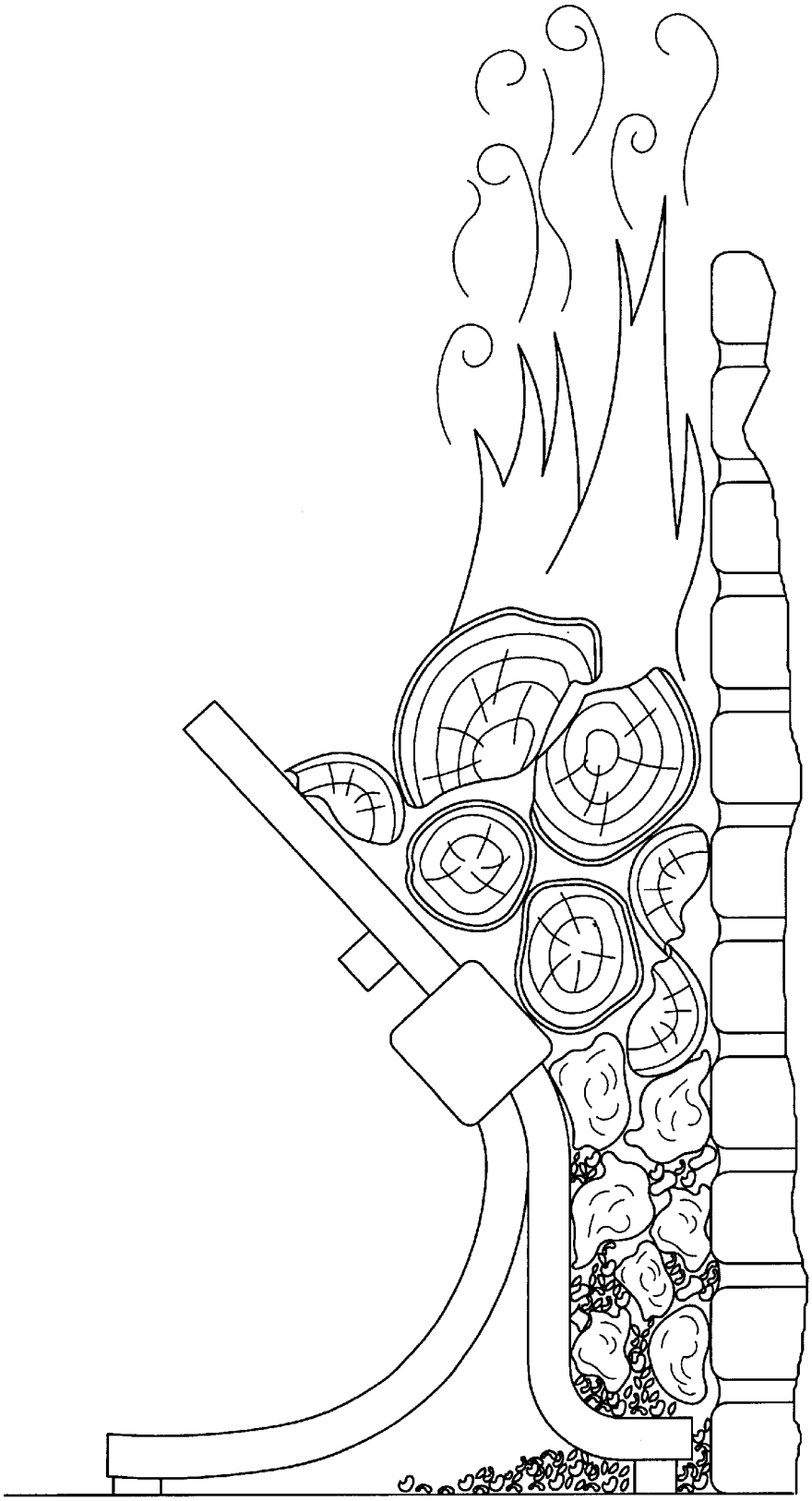
FIG. 5 is a slight variation of the FIGS. 3–4 grate.

In FIG. 5, the presently preferred form of the present invention is illustrated generally at 10*a*. The grate 10*a* is a simplified and yet highly efficient design with retaining members 16*a*, formed to provide the desired V-shape and single transverse connector and rear leg 20*a* supporting the grate in cooperation with a pair of front legs 22*a*,22*a*, similar to the front legs of the FIG. 1, 2 grate. An upper transverse frame member 50 secures the members 16*a*, in assembly. As in the case of the FIGS. 1, 2 grate, the lowermost portion of the ember bed rests on and thus maintains itself in close proximity to the floor which inhibits air flow therebeneath and provides for burn rate regulation and control. The dimension "a" in FIGS. 5 representing the distance between the fireplace floor and the lowermost log should not exceed that needed for fabrication and is shown as approximately two (2) inches or less.

The horizontal dimension "b" in FIG. 3 should fall in the range of three (3) to six (6) inches, approximately three and one half (3½) inches being presently preferred. The dimension "c" should be in the neighborhood of four and one-half (4½/) inches, and the width "d" near the top of the grate is preferably in the neighborhood of eight (8) inches. The total height of the grate "f" should be in the neighborhood of eighteen (18) inches.

With the foregoing dimensions, the grate configuration takes on the desired generally V-shape with the fireplace rear wall and a first vertical portion above a short horizontal lower end portion, a forwardly inclined intermediate portion above the vertical portion, and a top portion which is generally vertical except for a forwardly inclined lip portion, the latter for aesthetics as well as ease of introduction of logs to the grate.

In operation of the fireplace grate and particularly in starting a fire, newspaper or other suitable material may be employed adjacent and within the grate in a conventional manner. It will be noted that the usual difficulty encountered in forcing newspaper under a basket type grate is eliminated. With a grate of the present invention in position against the rear wall of a fireplace, it is only necessary to place a limited amount of crumpled newspaper within and/or against a front portion of the grate, rather than beneath the same. Suitable kindling or the like at a lower portion of the grate will then readily ignite.

Once combustion is initiated, the fire is confined to a limited rear portion of the fireplace and the adjacent rear fireplace wall is rapidly heated. Confinement of the fire occurs in a much smaller and rearwardly defined vertically extending area in the fireplace than in the case of a conventional broad base basket-type grate. Further, the logs, due to vertical stacking, are exposed forwardly to a much greater extent than in the case of a basket-type grate. This permits a greatly enhanced and uninhibited flow of draft air rearwardly through the grate and upwardly among the logs but confined to the rear portion of the fireplace. As a result, it is found that there is literally no smoke escape whatever forwardly through the face of the fireplace. The draft is also greatly enhanced by immediate heating of the rear wall and flue of the fireplace and during continuing combustion the other aforesaid features and advantages are present with each of the aforesaid embodiments of the invention.

What is claimed is:

1. A vertical stack rear draft fireplace grate which is completely open rearwardly and comprises a log retaining portion at the front which faces generally forwardly and extends angularly upwardly and forwardly from a lower end location closely adjacent the corner formed by the floor and rear wall of the fireplace, said grate portion retaining and supporting logs in cooperation with the generally vertical rear wall of the fireplace and defining therewith a sharp generally V-shaped upwardly open horizontal through opening viewed from the sides of the grate, said retaining portion comprising a plurality of parallel log supporting and retaining members spaced apart horizontally to cause embers to build upwardly therewithin as a fire progresses, the total area of forwardly open space between said supporting and retaining members being substantially greater than the total area of said members so as to permit heat generated by burning logs on the grate to radiate freely outwardly through the spaces and forwardly from the grate together with heat radiating forwardly from an ember bed therebeneath and within the grate, the grate being open at the top for the downward introduction of logs, and the configuration of lower and portions of the supporting and retaining members being substantially vertical and spaced horizontally from the rear fireplace wall such that a lowermost log is supported to bum above a vertical ember chamber thus discharging embers downwardly, and lowermost base portions of the supporting and retaining members being substantially in engagement with the fireplace floor and substantially horizontal so that the vertical portions are spaced from the rear fireplace wall a distance accommodating less than a single fireplace log of average diameter, at least one leg extending forwardly with an end portion engaging the fireplace floor a substantial distance from the grate and the other end portion secured to the log retaining portion of the grate at a substantial distance above the fireplace floor to maintain stability of the grate with the latter carrying a maximum number of logs.

2. A vertical stack—vertical rear draft fireplace grate as set forth in claim 1 wherein said log supporting and retaining members each have a short rearwardly extending generally horizontal base portion approximately three inches to five inches long, a substantially vertical portion integral therewith and extending upwardly from a front end of said base portion a distance approximating at least six inches, and a generally forwardly and upwardly inclined portion at least partially defining the aforesaid V-shape of the grate and accommodating a plurality of logs horizontally at the top.

3. A vertical stack—vertical rear draft fireplace grate as set forth in claim 1 wherein said log supporting and retaining members each have a short rearwardly extending generally horizontal base portion less than the diameter of an average fireplace log, a forwardly and upwardly inclined portion extending upwardly and at least partially defining the aforesaid V-shape of the grate, and a substantially vertical portion extending downwardly from said forwardly and upwardly inclined portion and defining an ember repository.

4. A vertical stack—vertical rear draft fireplace grate as set forth in claim 1 wherein said supporting and retaining members extend angularly upwardly and forwardly along a substantially linear path from said vertical portions.

5. A vertical stack—vertical rear draft fireplace grate as set forth in claim 1 wherein at least two horizontally spaced auxiliary log supporting members are provided and take the form of elongated angularly rearwardly and downwardly extending bars attached at their upper and front ends to log retaining members at upwardly spaced portions of the latter and attached at their rear ends to lower end portions of the log retaining members.

6. A vertical stack—vertical draft fireplace grate as set forth in claims wherein said auxiliary log supporting members are attached to their respective log retaining members at their front and upper ends at a height above the floor of the fire place at least equal to the diameter of two (2) average size logs.

7. A vertical stack—vertical draft fireplace grate as set forth in claim 1 wherein at least two horizontally spaced apart legs are provided for attachment to the grate for stabilizing the same, the legs extending downwardly and forwardly to prevent the grate from tipping forwardly when loaded with logs as aforesaid.

8. A vertical stack—vertical draft fireplace grate as set forth in claim 1 wherein said fireplace grate is of welded steel construction.

* * * * *